US006213323B1

(12) United States Patent
Ferrari

(10) Patent No.: US 6,213,323 B1
(45) Date of Patent: Apr. 10, 2001

(54) UNIVERSAL STOPPER FOR CLOSING OPENED BOTTLES, IN PARTICULAR FOR SPARKLING-WINE OR WINE BOTTLES

(75) Inventor: Ruggero Ferrari, Parma (IT)

(73) Assignee: Ferrari Group S.r.l., Parma (IT)

( * ) Notice: Subject to any disclaimer, the term of this patent is extended or adjusted under 35 U.S.C. 154(b) by 0 days.

(21) Appl. No.: 09/492,816

(22) Filed: Jan. 28, 2000

(30) Foreign Application Priority Data

Jan. 27, 1999 (IT) ..... PR9900005

(51) Int. Cl.[7] ..... B65D 45/02
(52) U.S. Cl. ..... 215/272; 215/277; 215/301
(58) Field of Search ..... 215/272, 273, 215/275, 277, 278, 282, 287, 293, 342, 301

(56) References Cited

U.S. PATENT DOCUMENTS 320,715 * 6/1885 Spriegel ..... 215/272
4,534,482 * 8/1985 Bouche ..... 215/272
4,634,029 * 1/1987 Hauser ..... 215/272
4,770,307 * 9/1988 Guglielmi ..... 215/272
5,803,288 * 9/1998 Munini ..... 215/275
5,957,313 * 9/1999 Bouan ..... 215/284

FOREIGN PATENT DOCUMENTS

2361256 * 6/1975 (DE) .
96/16876 * 6/1996 (WO) .

* cited by examiner

*Primary Examiner*—Nathan J. Newhouse
(74) *Attorney, Agent, or Firm*—Browdy and Neimark

(57) ABSTRACT

The present invention relates to a universal stopper for closing opened bottles (1), in particular for sparkling-wine or wine bottles. Said stopper comprises a hollow cylindrical body (2), a cap (7) for the hollow cylindrical body (2) and at least two tongues (8) which are inclined with respect to the longitudinal axis of the hollow cylindrical body, seated inside shaped recesses **(2*b*) and fixed to the hollow cylindrical body (2) by means of joints (9) forming an axis of rotation for said tongues. It also comprises securing means (10) acting against the tongues (8)** and designed to keep the said tongues pressed underneath the lip.

4 Claims, 3 Drawing Sheets

UNIVERSAL STOPPER FOR CLOSING OPENED BOTTLES, IN PARTICULAR FOR SPARKLING-WINE OR WINE BOTTLES

BACKGROUND OF THE INVENTION

The present invention relates to a universal stopper for closing opened bottles, in particular for sparkling-wine or wine bottles.

Stoppers for closing opened bottles containing sparkling wine or other types of wine are known, said stoppers generally comprising a cylindrical central body housing a spring which acts against a disc having a rubber seal for hermetically closing the bottle in the vicinity of the top edge of the opening.

Fixing of the stopper to the bottle is performed by movable elements comprising a tooth designed to be inserted underneath the external lip of the bottle.

Not only are these stoppers somewhat expensive, but they are also complex from an operational point of view since they require the use of both hands during both closing and re-opening of the bottle.

Stoppers operating by means of expansion are also known, said stoppers having a central body designed to be introduced inside the mouth of the bottle. Said central body has a rubber annular portion which, following the action of an external lever having the function of a cam, expands against the internal surfaces of the neck of the bottle, forming a seal. The central body has, in fact, an internal spindle, at one end of which the lever is pivotably mounted. Lowering the lever produces raising of the spindle inside the central body of the stopper which compresses the rubber annular portion and forces it to expand radially.

In addition to problems of sealing, owing to the high pressure inside bottles containing sparkling wine, the application of stoppers with a rubber annular portion which are operated by a lever having the fuiction of a cam requires a considerable amount of force and the need to use both hands in order to operate the lever and keep the bottle still. Stoppers which are normally used to close bottles containing water are also known, said stoppers comprising a plurality of sealing tongues which are forced underneath the lip. These stoppers, which are usually made of metals or plastic, have the drawback that they cannot be easily removed, require a considerable amount of force in order to re-open the bottle and cannot withstand the pressure which is generated inside a bottle containing sparkling wine.

In order to overcome the abovementioned drawbacks, a type of stopper forming the subject of patent application PR94U000024 has been devised, said stopper being formed by means of a hollow cylindrical body containing a seal pressed by a spring against the top part of the mouth of the bottle. Locking of the stopper with respect to the bottle is performed by means of two tongues which are designed to be arranged underneath the lip of the bottle. The tongues are inclined with respect to the central body and connected thereto by means of joints which allow the said tongues to rotate.

The abovementioned stopper is very simple to apply, in particular owing to the fact that it may be applied using one hand only, but has some problems associated with sealing on account of the plastic material forming the tongues and the cylindrical body. In fact, after prolonged use, during which the tongues are subject to numerous opening and closing cycles and therefore numerous rotational movements about the joints, the said material tends to lose its elasticity, and the sealing action of the tongues underneath the lip is limited and not constant over time.

Moreover, although developed as a universal stopper, its structure does not have the versatility such that it may be applied to different bottles comprising in particular different types of lip.

SUMMARY OF THE INVENTION

The object of the present invention is to eliminate the abovementioned drawbacks and provide a universal stopper which can be adapted to bottles having a lip with variable dimensions and shape and which maintains a sealing action over time without losing its elasticity.

A further object of the present invention is that of making both closing and opening of the bottle more convenient and easier, using if necessary only one hand.

Said objects are fully achieved by the universal stopper for closing opened bottles, in particular for sparkling-wine or wine bottles, according to the present invention, which is characterized by the contents of the claims indicated below.

In particular, the abovementioned stopper, the structure of which has at least two tongues intended to be fixed underneath the lip of the bottle, comprises securing means acting against the said tongues so as to ensure a good sealing action even after repeated use.

BRIEF DESCRIPTION OF THE DRAWINGS

These and other characteristic features will emerge more clearly from the following description of a preferred embodiment illustrated, purely by way of a non-limiting example, in the accompanying plates of drawings, in which.

DESCRIPTION OF THE PREFERRED EMBODIMENTS

Figure 1:
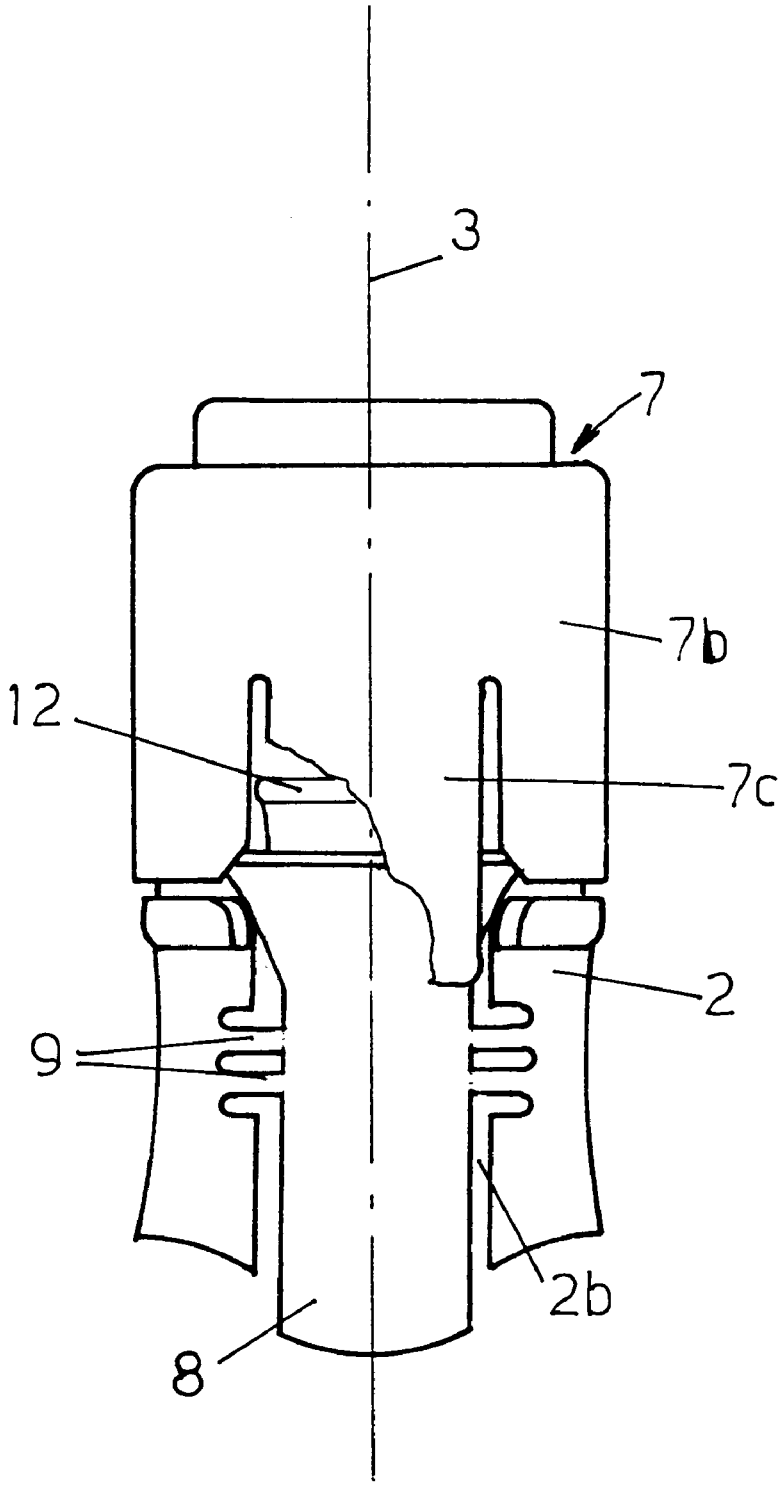
FIG. 1 shows a side view of a stopper.
Figure 2:
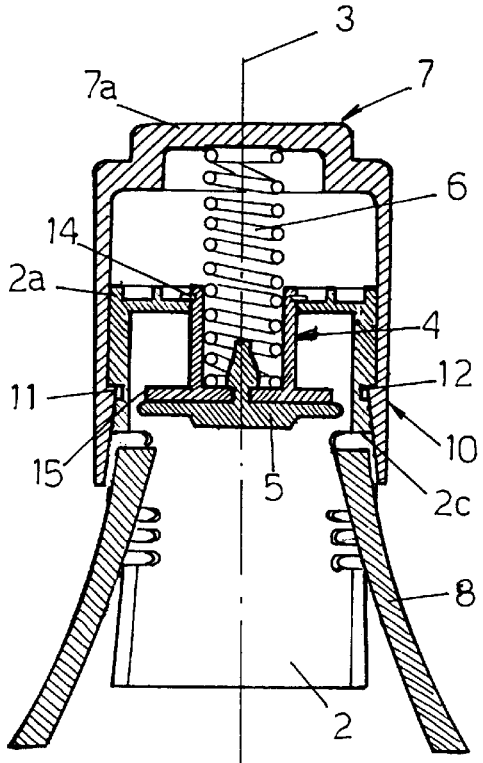
FIGS. 2 and 3 show a cross-sectional view of the stopper according to FIG. 1 during opening and closing, respectively.
Figure 3:
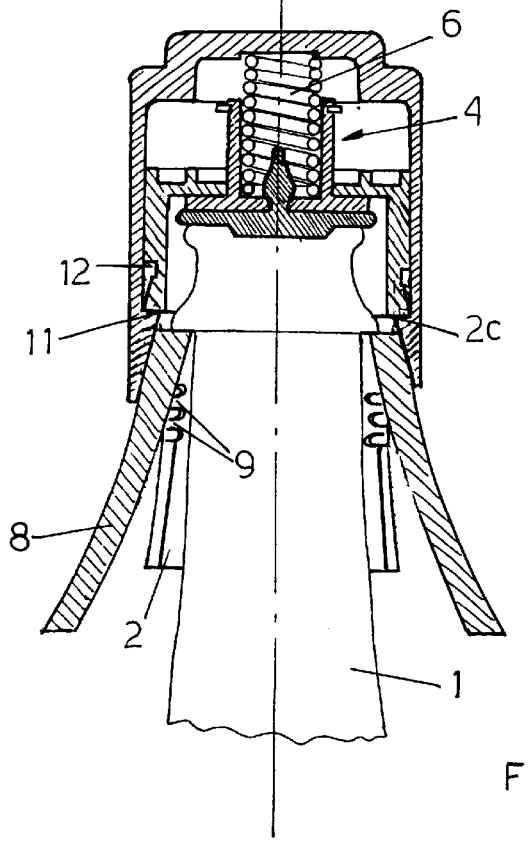

With reference to the figures, I denotes an opened bottle, in particular for sparkling wine or wine, intended to be closed again using a universal stopper according to the present invention which allows closing of the bottle I independently of the type and dimensions of the lip.

The abovementioned universal stopper comprises firstly a hollow cylindrical body 2 which has a longitudinal axis and is designed to be inserted onto the neck of the bottle 1, substantially coaxial therewith.

The hollow cylindrical body 2 has a base 2*a* with a hole housing a support 4 for a seal 5. The support 4 is able to slide with respect to the base 2*a* of the hollow cylindrical body 2 in the direction of the longitudinal axis 3 and comprises an upper end-of-travel stop 14 and a lower end-of-travel stop 15 which are positioned on opposite sides of the base 2*a* so as to form the end-of-travel stops for the translatory movement of the support 4.

The support 4 also acts as a housing for a sealing spring 6 intended to keep the seal 5 pressed against the mouth of the bottle 1.

The sealing spring 6 is inserted between the support 4 and a cap 7 of the hollow cylindrical body 2.

The side surface of the hollow cylindrical body 2 is not continuous and has at least two shaped incisions 2*b* comprising an upper edge 2*c*. Each of the shaped incisions 2*b* receives inside it a tongue 8 which is inclined with respect to the longitudinal axis 3 and fixed to the hollow cylindrical body 2 by means of joints 9. The tongues 8 and the joints 9 may be made of plastic moulded as one piece. Moreover, the tongues 8 may rotate about the joints 9 and are intended to be inserted underneath the lip of the bottle.

The relative locking between stopper and bottle is ensured in an original manner, not only by the tongues 8, but also by securing means 10 acting against the said tongues and designed to keep them pressed underneath the lip.

The securing means 10 comprise the cap 7 of the hollow cylindrical body 2 which is formed as a cylindrical structure with a base 7*a* having radial dimensions slightly greater than the hollow cylindrical body 2 and a side surface 7*b* comprising two extensions 7*c* which are arranged in diametrically opposite positions corresponding to the tongues 8. The cap 7 is mounted on the hollow cylindrical body 2 and is slidable with respect thereto along the longitudinal axis 3.

The extensions 7*c* comprise internally a locating shoulder 11, while the hollow cylindrical body 2 comprises on its external surface, opposite each tongue 8, a recess 12 inside which the locating shoulder 11 engages.

When the stopper is not positioned on the bottle 1, the cap 7 is fixed onto the hollow cylindrical body 2 by means of the interaction between the locating shoulder 11 and the recess 12. Inside the hollow cylindrical body 2, the upper end-of-travel stop of the support 4 is in contact with the base 2*a* of the hollow cylindrical body, and the sealing spring 6, which is arranged between the support 4 and the base 7*a* of the cap 7, is located in its fully extended position.

During positioning of the cap on the bottle, it is sufficient to insert the hollow cylindrical body 2 on the neck of the bottle I and press the cap 7 so as to lock the tongues 8 underneath the lip. The securing means 10 ensure a more reliable and constant locking action, over time, of the tongues 8.

In fact, pressing the cap 7 causes relative sliding of the said cap with respect to the hollow cylindrical body 2 until the locating shoulder I I engages underneath the upper edge 2*c* of the shaped incisions 2*b*.

In this way the extensions 7*c* of the cap 7 are positioned on the tongues 8, keeping them pressed underneath the lip.

In order to open the bottle again, it is sufficient to press the projecting part of the tongues 8 which are thus freed from underneath the lip and allow the locating shoulder 11 to be freed from the upper edge 2*c* of the shaped incisions 2*b*. Compression of the sealing spring 6 brings the cap back into the initial position and the locating shoulder 11 engages inside the recess 12.

Figure 4:
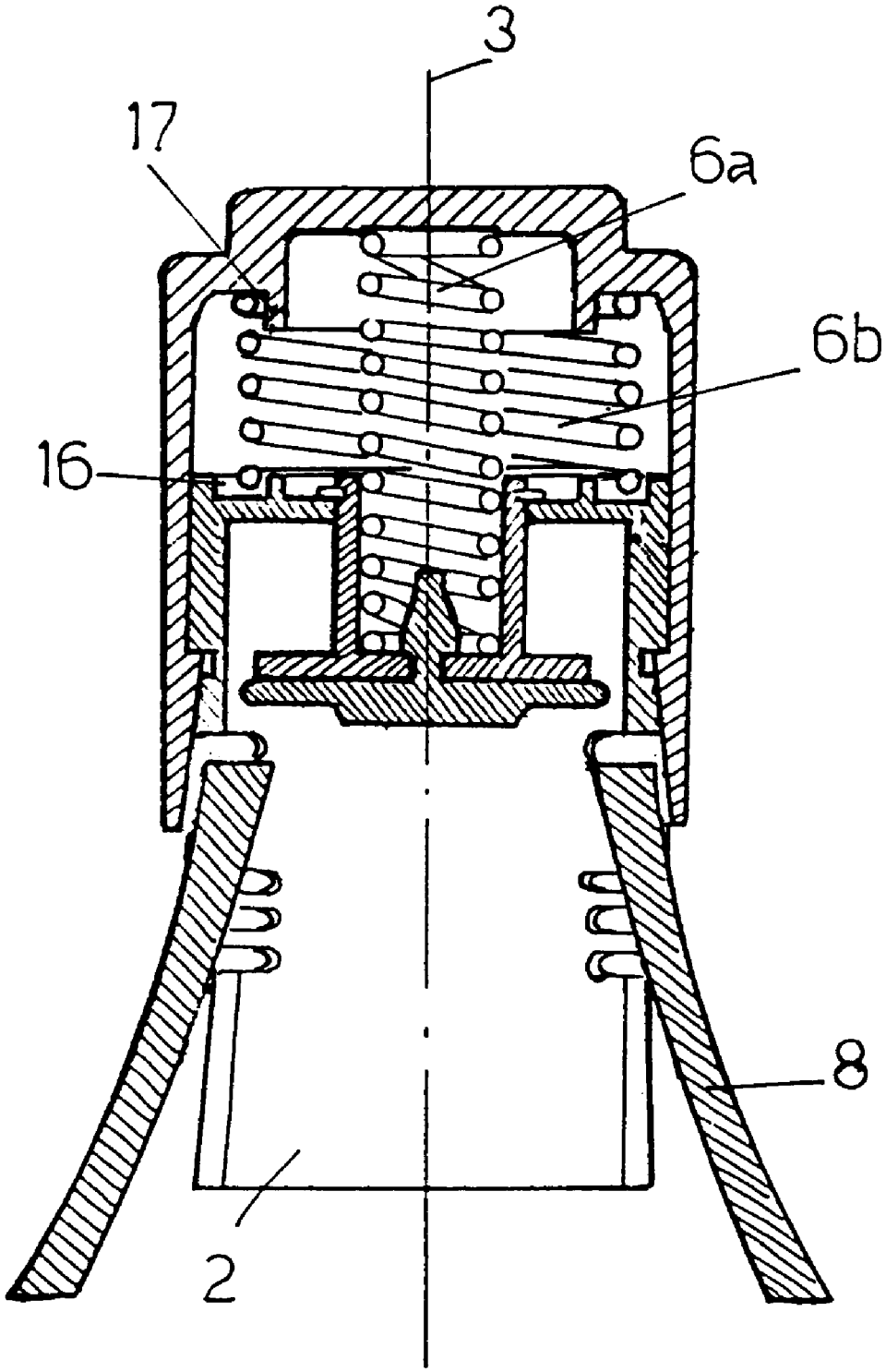
FIG. 4 shows a variation of embodiment of the stopper according to FIG. 1.

In a variation of embodiment illustrated in FIG. 4, two sealing springs 6*a* and 6*b* of varying stiffness may be inserted coaxially between the cap 7 and the base 2*a* of the hollow cylindrical body 2 so that one performs the function of providing a sealing action between the seal and the mouth of the bottle, and the other one causes, during opening of the bottle, the return travel of the cap with respect to the hollow cylindrical body. For this purpose the base 2*a* of the hollow cylindrical body may comprise a seating 16 for the second sealing spring 6*b*, while the base 7*a* of the cap 7 may comprises an annular shoulder 17.

The operating principle of the variation illustrated in FIG. 4 is similar to that of the stopper according to FIG. 1.

What is claimed is:

1. Universal stopper for closing opened bottles (1), in particular for sparkling-wine or wine bottles, of the type comprising:

a hollow cylindrical body (2), with a longitudinal axis (3), designed to be inserted onto the neck of the bottle (1), substantially coaxial therewith;

a support (4) for a seal (5), housed inside the hollow cylindrical body (2) so as to be able to slide with respect thereto in the direction of the longitudinal axis (3) and having the function of a housing for at least one sealing spring (6) which is intended to keep the seal (5) against the mouth of the bottle (1);

a cap (7) for the hollow cylindrical body (2) which performs the function of an abutment for the sealing spring (6) during sliding of the support (4);

at least two tongues (8) which are inclined with respect to the longitudinal axis (3), seated inside shaped recesses (2*b*) and fixed to the hollow cylindrical body (2) by means of joints (9) forming an axis of rotation for said tongues and which are designed to be inserted underneath the lip of the bottle (1), characterized in that it comprises securing means (10) acting against the tongues (8) and designed to keep the said tongues pressed underneath the lip.

2. Stopper according to claim 1, in which the securing means (10) comprise:

the cap (7) of the hollow cylindrical body (2) which is formed as a cylindrical structure with a base (7*a*) having radial dimensions slightly greater than the hollow cylindrical body (2) and a side surface (7*b*) comprising, for each tongue (8), an extension (7*c*) having a locating shoulder (11) designed to be fixed inside a recess (12) formed on the surface of the hollow cylindrical body (2);

an upper edge (2*c*) of the shaped incisions (2*b*) formed in the surface of the hollow cylindrical body (2) so that pressing the stopper on the bottle (1) causes the extensions (7*c*) of the cap (7) to be locked in the closed position, bringing the locating shoulder (11) underneath the upper edge (2*c*) and keeping the tongues (8) pressed underneath the lip.

3. Stopper according to claim 1, in which two sealing springs (6*a* and 6*b*) of varying stiffness are arranged between the cap (7) and the hollow cylindrical body (2) so as to divide the functions of providing a sealing action between the seal (5) and the mouth of the bottle and ensuring the resilient return movement of the cap (7) with respect to the hollow cylindrical body (2) during opening of the said bottle.

4. Stopper according to claim 1, in which the hollow cylindrical body (2), the tongues (8) and the joints (9) are made of plastic moulded as one piece.

* * * * *